US008607522B2

(12) United States Patent
MacDonald

(10) Patent No.: US 8,607,522 B2
(45) Date of Patent: Dec. 17, 2013

(54) BLOCK SYSTEM WITH CORNER BLOCK AND METHOD OF MANUFACTURING A BLOCK

(71) Applicant: Robert A. MacDonald, Plymouth, MN (US)

(72) Inventor: Robert A. MacDonald, Plymouth, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 0 days.

(21) Appl. No.: 13/647,083

(22) Filed: Oct. 8, 2012

(65) Prior Publication Data

US 2013/0025227 A1 Jan. 31, 2013

Related U.S. Application Data

(63) Continuation of application No. 12/363,231, filed on Jan. 30, 2009, now abandoned.

(60) Provisional application No. 61/024,668, filed on Jan. 30, 2008.

(51) Int. Cl.
*E04B 1/02* (2006.01)

(52) U.S. Cl.
USPC ..... 52/562; 52/284; 52/604

(58) Field of Classification Search
USPC ..... 52/284, 562, 604, 608, 609, 610, 571; 405/284, 286
See application file for complete search history.

(56) References Cited

U.S. PATENT DOCUMENTS

| | | | | |
|---|---|---|---|---|
| 252,747 | A | 1/1882 | Edwards | |
| 738,643 | A | 9/1903 | Van Camp | |
| 1,170,936 | A * | 2/1916 | Royse | 138/115 |
| 1,379,965 | A | 5/1921 | Cleland | |
| 2,994,162 | A * | 8/1961 | Frantz | 52/592.5 |
| 3,391,507 | A | 7/1968 | Downing | |
| 4,182,089 | A | 1/1980 | Cook | |
| 4,253,636 | A | 3/1981 | Grady et al. | |
| 5,078,354 | A | 1/1992 | Kim | |
| 5,131,202 | A * | 7/1992 | Ball | 52/596 |
| 5,398,474 | A * | 3/1995 | McClinton | 52/284 |
| 5,548,936 | A * | 8/1996 | McClinton et al. | 52/284 |
| 6,035,599 | A | 3/2000 | Sonnentag | |

(Continued)

FOREIGN PATENT DOCUMENTS

| | | | |
|---|---|---|---|
| FR | 2 550 568 | A3 | 2/1985 |
| WO | WO 94/23136 | A3 | 10/1884 |
| WO | WO 94/23136 | A2 | 10/1994 |
| WO | WO 2005/009707 | | 2/2005 |

OTHER PUBLICATIONS

Abstract for FR 2 550 568 A3 (1 page).

(Continued)

*Primary Examiner* — Brian Glessner
*Assistant Examiner* — Patrick Maestri
(74) *Attorney, Agent, or Firm* — Popovich, Wiles & O'Connell, P.A.

(57) ABSTRACT

A corner block and a wall block system with a corner block for forming in multiple courses a wall which includes first and second visible wall portions which meet at a corner and where the corner block has a front face and at least one side surface having a texture or pattern matching the texture or pattern of a front face of a first block of the wall system.

20 Claims, 9 Drawing Sheets

(56) References Cited

U.S. PATENT DOCUMENTS

| | | | | |
|---|---|---|---|---|
| 6,912,823 | B2 * | 7/2005 | MacDonald et al. | 52/574 |
| 7,823,858 | B2 | 11/2010 | Matsufuji et al. | |
| 2005/0108973 | A1 * | 5/2005 | Hammer et al. | 52/596 |
| 2009/0188196 | A1 | 7/2009 | MacDonald | |

OTHER PUBLICATIONS

International Search Report and Written Opinion of PCT Application No. PCT/US2009/032637, dated Jun. 24, 2009, 13 pages total.

* cited by examiner

Fig. 2A
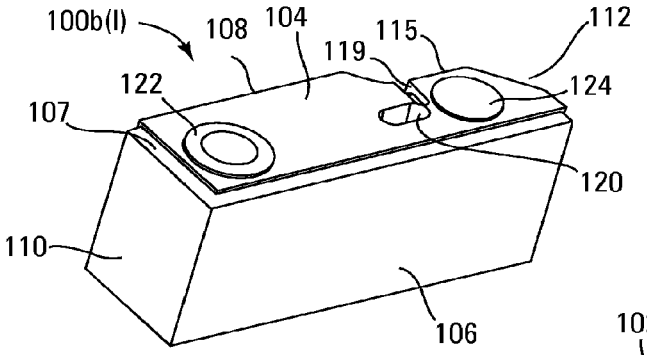
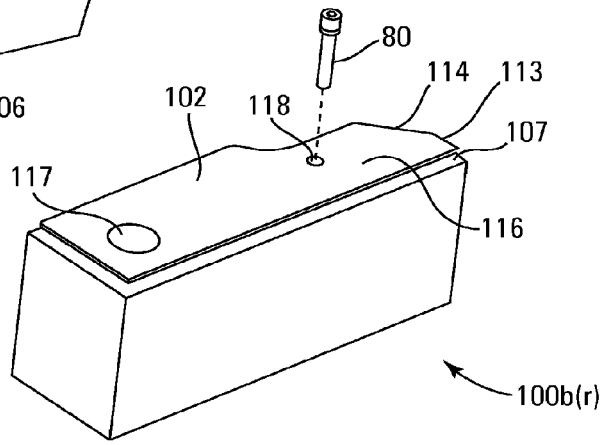
Fig. 2B
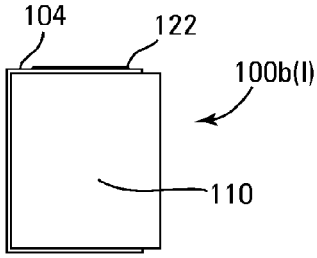
Fig. 2C
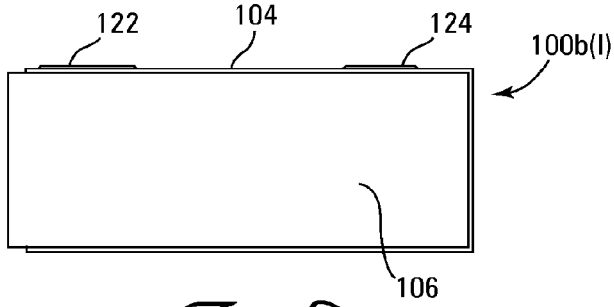
Fig. 2D

BLOCK SYSTEM WITH CORNER BLOCK AND METHOD OF MANUFACTURING A BLOCK

This application is a continuation of U.S. patent application Ser. No. 12/363,231, filed Jan. 30, 2009, which claims the benefit of U.S. Provisional Application No. 61/024,668, filed Jan. 30, 2008, entitled "Block System With Corner Block and Method of Manufacturing a Block", the contents of each of which are hereby incorporated by reference herein.

FIELD OF THE INVENTION

This invention relates generally to a method of manufacturing a block, the block and walls constructed from such blocks. In particular, this invention relates to a block manufactured with two or more faces that are used in the formation of a corner of a structure such as a wall or fence and additionally the two or more faces of the block for the corner may have the same texture as the blocks used to build the rest of the structure.

BACKGROUND OF THE INVENTION

In the manufacture of wall blocks and other kinds of blocks made from concrete, it is common to use a mold that forms a block module which is then split to form two or more blocks. When a block module is split, the split surface has an irregular appearance, which is desirable if the desired look is one of natural stone. A split block appearance has a desirable appearance for many applications, such as retaining walls and landscaping products.

A typical wall block has substantially parallel top and bottom surfaces and substantially parallel front and back surfaces. Side surfaces may have various angles or contours relative to the front and back surfaces, or could also be substantially parallel. In forming block modules of such blocks, it is often standard practice to split a block module on a plane coincident with the front faces of two blocks, thus giving the front faces of two opposing blocks an irregular (i.e., roughened) appearance.

U.S. Pat. No. 5,827,015 describes the conventional dry cast manufacturing process used to manufacture concrete wall blocks. In such process, a mold box is used to form a slab that is subsequently split into two wall blocks. It is also known to provide mold boxes which can simultaneously form multiple slabs of identical size and shape.

Another important feature of wall blocks and blocks used in either retaining walls or free standing walls is the appearance of the block. Specifically, it is desirable that exposed portions of the blocks which form the wall have a visually pleasing appearance. The look of weathered natural stone is very appealing for walls. There are several methods in the art to produce concrete wall blocks having an appearance that to varying degrees mimics the look of natural stone. One well known method is to split the block during the manufacturing process so that the front face of the block has a fractured concrete surface that looks like a natural split rock. This is done by forming a slab in a mold and providing one or more grooves in the slab to function as one or more splitting planes. The slab is then split apart to form two or more blocks. Another method is wherein blocks are individually formed in a mold and the surfaces are textured by removal of the mold. Additional machine texturing processes can then be applied. Many manufacturers also vary the color and the texture or pattern on the front face of the block. It might be desirable for the face of the block to be smooth, serrated, or grooved or to have an aggregate appearance.

Another method to create a weathered stone appearance is to tumble the blocks together with other blocks in a large rotating canister. The collisions of the blocks in the tumbler chips off random pieces of the blocks, rounding the edges and creating a look that can be quite close to the appearance of a natural stone. This is a labor intensive undertaking that also can result in undesirable damage to the blocks and high overall costs of production.

Another known method of creating a block having one or more irregular or textured surfaces is to form the block in a mold box that has been provided with a sidewall liner shaped to impart the irregular or textured surface on the block during the block molding process. The block is formed in a cavity bounded by a pallet upon which the mold box rests and the sidewalls of the mold box. After the material which forms the block has set enough to retain its shape a compression head having a stripper shoe positioned above the top of the mold box is used to compress the material and urge it out through the bottom of the mold box. The block remains on the pallet and is moved to a curing station. Additionally or alternatively, the sidewalls of the mold box, especially those provided with a textured or patterned sidewall liner, may be moveable away from the block material before it is removed from the mold box.

Various block systems used to make retaining walls or free standing walls are known in the art. Since only one surface or face of blocks used to form retaining walls is exposed only the exposed surface need be formed with a texture or pattern in order for the wall to have a desired patterned or textured appearance. In freestanding walls both sides of the wall are exposed. Therefore, if it is desired that both sides of the wall have a textured or patterned appearance than the blocks forming the wall must be formed with opposing textured or patterned surfaces on the surfaces which will be exposed. These blocks systems can be used to form walls which are straight or curved gradually inwardly or outwardly and which maintain the desired textured or patterned appearance along the exposed wall surface. Difficulties arise, however, when it is necessary or desirable to construct the wall with a corner. It is desirable that the corners of the wall continue or maintain the same visual appearance that is created by the straight or gradually curved portions of the wall. Typically, the blocks used to form the straight or curved wall surfaces are not configured to form corners such as 90 degree corners. For example, although these blocks are textured or patterned on the exposed face the adjacent side surface of the block which would be exposed at a corner of the wall is not similarly textured or patterned. Additionally, these block systems usually include some way of connecting adjacent courses of blocks such as flanges or pins. With known prior art block systems substantial modifications are typically required in the field by the installers in order to form a corner. Portions of the blocks may need to be cut away by the installer and other modifications to the connection system made in order to make the blocks work at a corner. Even with such field modifications it is extremely difficult to maintain both the desired outward visual appearance of the wall and wall stability at the corners.

Therefore, there is a need in the art for a block that can be used in the formation of a corner that has two surfaces with a texture that is similar to blocks used in the construction of the rest of the wall.

Additionally there is a need in the art for a block that can be used in the formation of a corner for multiple wall systems and that could be molded with a texture substantially similar to the blocks of the wall system it is being applied.

Additionally there is a need in the art for a block that can be used in the formation of a corner for multiple wall systems and having a connection system compatible with the wall system being used.

Additionally there is a need in the art for a block that can be used in the formation of a corner for multiple wall systems to create a consistent and precise running bond pattern for both segments of the wall formed with the corner.

SUMMARY OF THE INVENTION

The present invention is directed generally at a corner block for use with wall blocks in forming walls with corners. In one embodiment the invention is a wall block system for forming in multiple courses a wall which includes first and second visible wall portions which meet at a corner. The wall system may have a plurality of first blocks having opposed top and bottom surfaces, opposed side surfaces, and opposed front and back faces, the front face having a length and having a texture or pattern to present a desired visual appearance, the first blocks being configured to be assembled in adjacent courses such that the front faces of the first blocks form the first and second visible wall portions except at the corner. The wall system may have a plurality of corner blocks having opposed top and bottom surfaces, opposed side surfaces, and opposed front and back faces, the front face and one of the side surfaces having a texture or pattern matching the texture or pattern of the front face of the first block, the front face having a length and the one of the side surfaces having a texture or pattern having a width. The wall system may or may not include each of the corner blocks having a core extending from the top surface to the bottom surface. The corner blocks may be configured to be assembled in courses at the corner of the wall in an alternating manner such that the textured or patterned front face and side surface of a corner block in a first course are exposed along the first visible wall portion and second visible wall portion, respectively, and the textured or patterned front face and side surface of corner blocks in adjacent courses are exposed along the second visible wall portion and the first visible wall portion, respectively. The wall system may have the length of the front face of the corner blocks less the width of the side surface having a texture or pattern being equal to about one-half the length of the front face of the first blocks.

In one embodiment the wall block system may have corner blocks which include right handed corner blocks and left handed corner blocks. In a second embodiment the wall block system may include corner blocks that have weight bearing pads formed on one of the opposed top and bottom surfaces. In another embodiment the wall block system may include a pin hole on the top surface of the corner blocks and a pin receiving cavity on the bottom surface of the corner blocks. The invention described herein also includes a retaining wall formed with the wall block system and a method of constructing a retaining wall using the block system.

In one embodiment the invention is a method of constructing a wall with a corner block having the features described herein. In another embodiment the invention is a wall constructed using the corner block described herein.

The present invention is additionally directed generally at a mold assembly including a mold box for forming wall blocks. The mold box may have first and second opposing end frame walls; first and second opposing side frame walls; a division plate extending between the first and second end frame walls; first and second moveable end liners which are moveable between a first extended position and a second retracted position and third and fourth end liners. The mold box may also have first and second moveable side liners which are moveable between a first extended position and a second retracted position, the first moveable side liner, division plate, first moveable end liner and third end liner forming a first mold cavity when the moveable side liner and first moveable end liner are in the extended position, the second moveable side liner, division plate, second moveable end liner and fourth end liner forming a second mold cavity when the second moveable side liner and second moveable end liner are in the extended position. The third and fourth end liners may be movable between a first extended position and a second retracted position. In one embodiment first and second corner blocks of the block system of the present invention are formed in the first and second mold cavities of the mold box. The mold assembly may include a compression head or stripper shoe, a core bar and/or core forming bridges.

In another embodiment the invention is a method of forming a corner block in a mold assembly as described herein.

It is to be understood that both the foregoing general description and the following detailed description are exemplary and explanatory and are intended to provide further explanation of the invention as claimed.

BRIEF DESCRIPTION OF THE DRAWINGS

A preferred form of the present invention will now be described by way of example with reference to the accompanying drawings, wherein:

FIGS. 2A and 2B are perspective views of the top and bottom surfaces, respectively, of the corner block embodiment of FIG. 1B of the present invention. FIGS. 2C and 2D are side and front views respectively of the corner block of FIGS. 2A and 2B.

DETAILED DESCRIPTION OF PREFERRED EMBODIMENTS

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block, typically in a half bond or running bond pattern.

The blocks of this invention may be made of a rugged, weather resistant material, such as concrete, especially if the wall is constructed outdoors. Other suitable materials include plastic, reinforced fibers, and any other materials suitable for use in molding wall blocks. The surface of the blocks may be smooth or may have a roughened appearance, such as that of natural stone. The blocks are formed in a mold and various textures can be formed on the surface, as is known in the art.

Figure 1A:
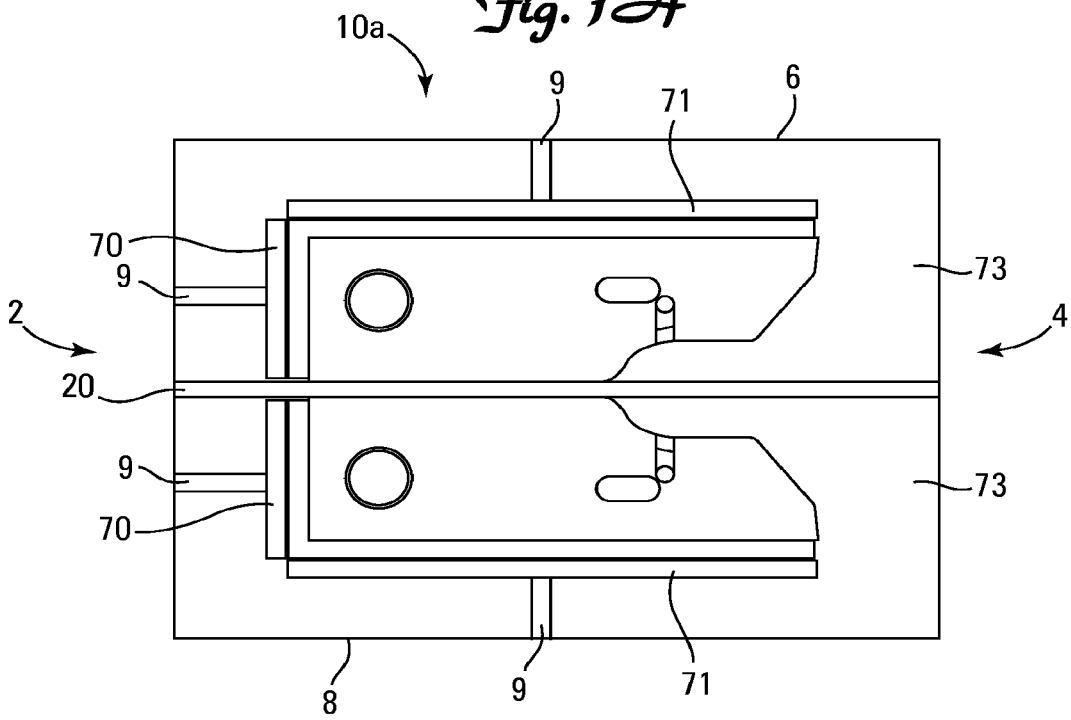
FIGS. 1A to 1C are top views of mold boxes containing corner blocks with bottom surfaces facing up of the present invention illustrating first, second and third corner block embodiments.
Figure 1B:
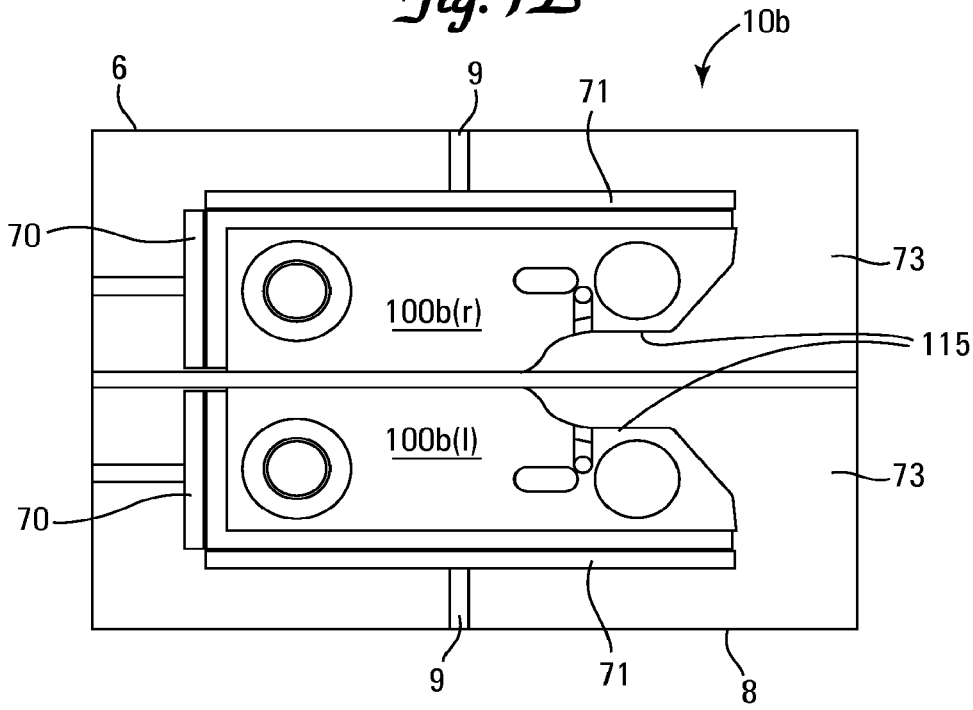
Figure 1C:
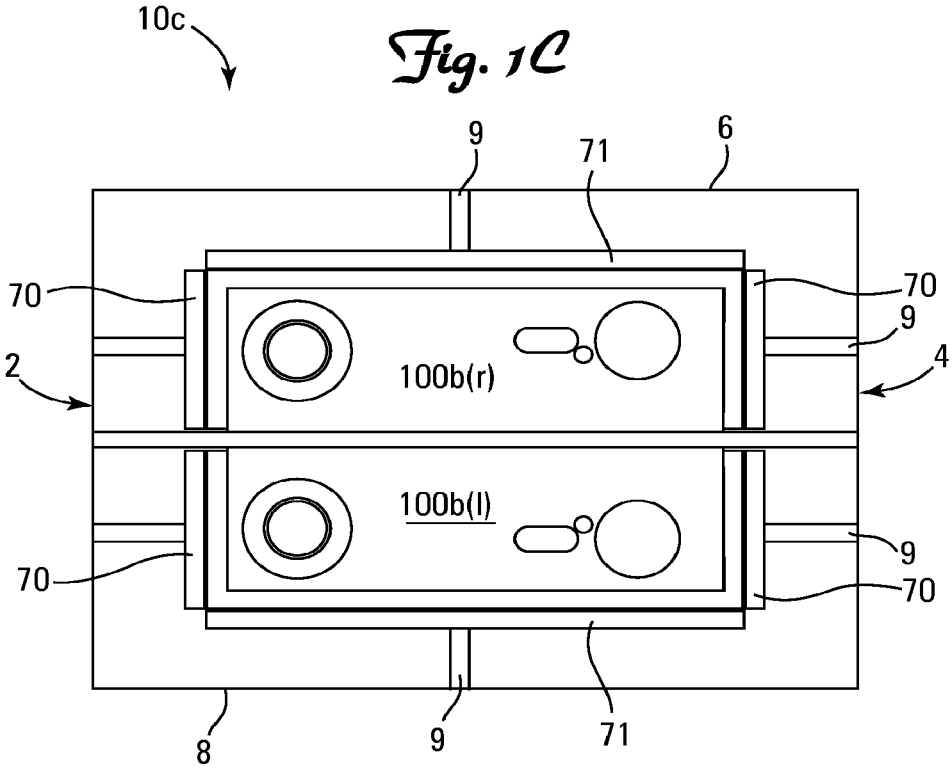

FIGS. 1A to 1C illustrate multiple embodiments of a corner block of the present invention formed in a mold box. Multi-block mold boxes 10*a* to 10*c* generally include opposing first and second end frame walls 2 and 4 and opposing first and second side frame walls 6 and 8. Division plate 20 spans end walls 2 and 4 of mold boxes 10*a* to 10*c*. Mold boxes 10*a* to 10*c* also include moveable liner mechanisms which are attached to impression end and side face liners 70 and 71, respectively. During the block production cycle the movable liner mechanisms are positioned in a first inward or block forming position when the mold cavities are filled with moldable material. The drive means for the moveable liner mechanisms are not shown in detail but may be driven with pistons 9, hydraulic or pneumatic cylinders or gear driven in accordance with known techniques. The impression end and side face liners 70 and 71 may be created with any desired pattern and impart to the front and side faces of the corner blocks any desired texture or pattern when in this first position. The end face liners 70 can imprint any desired texture onto a side surface of the corner block as in the embodiments shown in FIGS. 1A and 1B or both side surfaces of the corner block as in the embodiment shown in FIG. 1C. When the blocks have been formed and are ready to be discharged from the mold cavities the moveable liner mechanisms are moved to a second retracted or discharge position. In this retracted position the impression side and end face liners are spaced from the front and side faces of the blocks far enough to allow the blocks to be discharged from the mold cavities without interference from the face liners.

Stationary end liners 73, as shown in FIGS. 1A and 1B, form a neck portion of the corner block as described below. Although not shown, a stripper shoe or compression head is used to compact the material in the mold cavities and to aid in discharging the blocks from the mold cavities when the production cycle is complete. Typically, a lower surface of the compression head which contacts the block at the top of the open mold cavity lies in a generally horizontal plane. The compression head may have a texture or pattern to impart such texture or pattern to the portion of the block at the open top of the mold cavity.

It should be noted that all liners could also be fixed or stationary as stationary end liner 73 described above and may be additionally imprinted with a desired texture. Further, the stationary liners could be tapered from narrower towards the top of the mold to wider towards the bottom and given a strata and ledge design to imprint on the side and front faces of the corner block. Thus the bottom surface, which faces up, would have a smaller surface area than the top surface which is facing down. Thus the stripper shoe would be able to push the mold through the mold box and onto the production pallet more readily.

Though mold boxes 10*a* to 10*c* may have various dimensions, typical dimensions are about 18.5 inches (47.0 cm) wide (i.e., the width of both the first and second end walls), 26.0 inches (66.0 cm) long (i.e., the length of both the first and second side walls), and 8 inches (20.4 cm) thick.

The mold boxes of FIGS. 1B and 1C produce corner blocks 100*b*(*r*) and 100*b*(1) which are mirror images of one another, thus they have a right and left handed orientation, respectively. Although the mold box of FIG. 1A also produces blocks as a mirror images of one another, the blocks have top and bottom surfaces which are substantially similar thus allowing for the top surface to be used as the bottom surface or the bottom surface to be used as the top surface and therefore making the blocks interchangeable.

FIGS. 2A, 2C and 2D illustrate block 100*b*(1) with left handed orientation formed from the mold box 10*b* of FIG. 1B. FIG. 2B illustrates block 100*b*(*r*) with right handed orientation formed from the mold box 10*b* of FIG. 1B. It should be understood that blocks 100*b*(1) and 100*b*(*r*) have the same features located as mirror images from one another. Thus, the description of structure of both blocks is interchangeable as described below. Corner block 100*b* comprises opposing and substantially parallel upper or top and lower or bottom surfaces 102 and 104 respectively, and opposing and substantially parallel front and back faces 106 and 108, respectively. Front face 106 shows a line 107 adjacent the top and sides of the block which represents the area of the impression face and is produced by the thickness of the imprint texture which is ¾ to 1 inch thick. It should be noted that a smooth bevel or chamfer could be added to the block instead of the impressed edge during the molding process as desired. Corner block 100*b* also comprises opposing side surfaces 110 and 112. Side surface 110 also has line 107 representing the area of the impression face and may be optionally beveled as well. Side surface 112 is formed of angular surfaces 113 and 114. Angular surface 115 adjacent to rear face 108 extends from angled side surface 114. Neck 116 is formed from surface 115 and the corresponding length of surface 115 on front face 106, in addition to side surface 112. Neck 116 is indented the contour of angular surfaces 114 and 115 into the body of block 100*b* from back surface 108, the function of which is described in detail below. Front face 106 and rear face 108 each extend from top surface 102 to bottom surface 104 and side wall surfaces or ends 110 and 112 each extend from top surface 102 to bottom surface 104 and from front face 106 to rear face 108.

Block 100*b* further comprises core 117 and pin hole 118 which extend the full width of the block. It should be understood that core 117 is an optional feature of any of the corner blocks described herein and may be omitted if desired. The lower surface of each block has pin hole indentations 119 which result from the attachment of core forming bridges (not shown) to the division liner of the mold box to form the pin holes in the mold. This may be used instead of a core bar placed across a top plate (not shown) of the mold which may impart a slight groove, channel or indentation along the surface of the corner block. The lower surface of block 100*b* also has pin receiving cavity 120 and can be positioned at any desired location along the front portion of the block and may have any desired shape. The placement of cavities 120 in conjunction with pin hole 118 can be used to form a running-bond pattern in a wall of blocks. The pin receiving cavities are shown as depressions in the corner block but could also extend from the top to the bottom of the block, which aids in minimizing block weight as so desired. It should be understood that the placement and position of the pin holes and pin receiving cavities may be selected to ensure that the corner block is compatible with the wall blocks that the corner blocks are to be used with. See for example FIGS. 4A, 5A, and 8A which show alternative pin hole and pin receiving cavity arrangements.

Lower surface 104 of the block also has raised surfaces 122 and 124 which function as weight bearing pads. Weight bearing pad 122 surrounds cavity 117 and weight bearing pad 124 is located on neck 116. These weight bearing pads may be imparted onto the bottom surface of block 100*b* by adjustable or stationary tamper heads which are recessed into the lower portion of a stripper shoe of the molding process as disclosed in U.S. Patent Application Serial No. 60/986,483, entitled "Wall Block with Weight Bearing Pads and Method of Producing Wall Blocks", filed Nov. 8, 2007 hereby incorporated herein by reference. In this embodiment two weight bearing pads are formed but it should be understood that the number and position of the weight bearing pads can be varied. This embodiment is meant to be used with a wall block system where the blocks used to form the wall have similar weight bearing pads. Thus these corner blocks will be compatible with the other blocks in the system such as those described in the ∝483 application identified above. The amount by which each pad is raised from the bottom surface of the corner blocks depends on the dimensions of the weight bearing pads of the other blocks in the system. It should be understood that the weight bearing pads are an optional feature and may be omitted, for example, if the corner blocks are used with a block system where the other blocks in the system do not have weight bearing pads. It should further be noted that blocks formed in the same mold may be formed with mirror image features or may be formed with differing features and locations of features depending upon the application.

Though block 100*b* may have various dimensions, typical dimensions of this block are about 6 inches (15.2 cm) wide (i.e., the width of side surface 110), 18 inches (45.7 cm) long (i.e., the length of front face 106), and 8 inches (20.4 cm) thick (i.e., the thickness between the opposing upper and lower surface). These dimensions are generally smaller than the dimensions of the blocks used to form the retaining wall. The dimensions are advantageous in that they allow the blocks to be formed in a standard size mold box but leave enough room for the moveable liner mechanisms 70, 71 on three sides of the mold box. Thus, two corner blocks with a right and left handed configuration, can be formed simultaneously in a mold box, each corner block having adjacent textured or patterned side as described above.

The corner blocks in mold box 10*a* as illustrated in FIG. 1A are similar to the blocks formed in box 10*b* except they do not have the weight bearing pads. Additionally, they may be provided with a pin receiving cavity that extends the entire thickness of the block so that the top and bottom surfaces are interchangeable. The corner blocks in mold block 10*c* as illustrated in FIG. 1C are substantially rectangular and could have both side surfaces imprinted with the same or different patterns as imprinted on the front face. Additionally the weight bearing pads could be left off the corner block produced in mold box 10*c* which would make the top and bottom surfaces interchangeable and take away the right and left handed orientation of the corner block which may be desirable depending upon the application. Locations of pin holes, and pin receiving cavities could vary in embodiments described herein. It is to be understood that the corner block is not to be limiting and that the block as shown in molds 1A to 1C and in FIGS. 2A to 2D may have other additional features not described.

Corner block 100*b* can be used in the formation of corners in a wall system with various blocks as so desired. Specifically, and as described above, corner block 100*b* can be used with the blocks disclosed in the '483 application.

Figure 3A:
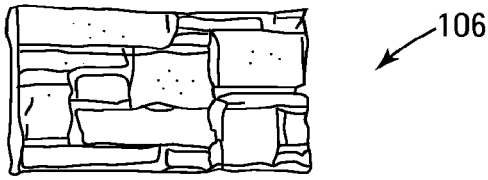
FIGS. 3A to 3C illustrate front views of alternate embodiments of the front face of the corner block of the present invention.
Figure 3B:
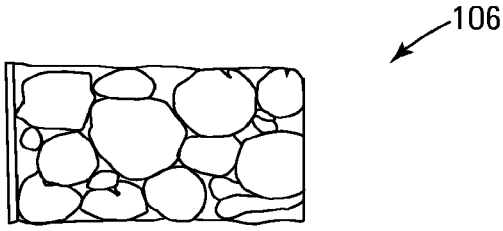
Figure 3C:
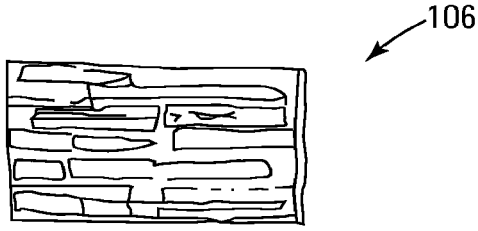

FIGS. 3A to 3C illustrate front views of alternate embodiments of the front face of the corner block of the present invention. It should be noted that alternate patterns imprinted onto the surface of the front face of the corner block can also be imprinted onto the side surface or other surfaces of the corner block as desired and when applicable. FIG. 3A illustrates an ashlar pattern molded onto front surface 106 of the corner block. FIG. 3B illustrates a boulder rock pattern molded onto front surface 106 of the corner block and FIG. 3C illustrates a ledge-rock pattern molded onto front surface 106 of the corner block. It should be noted that the patterns shown are not limiting and that various other patterns could be imprinted onto the front surface of the panel in order to achieve a desired visual appearance.

Figure 4A:
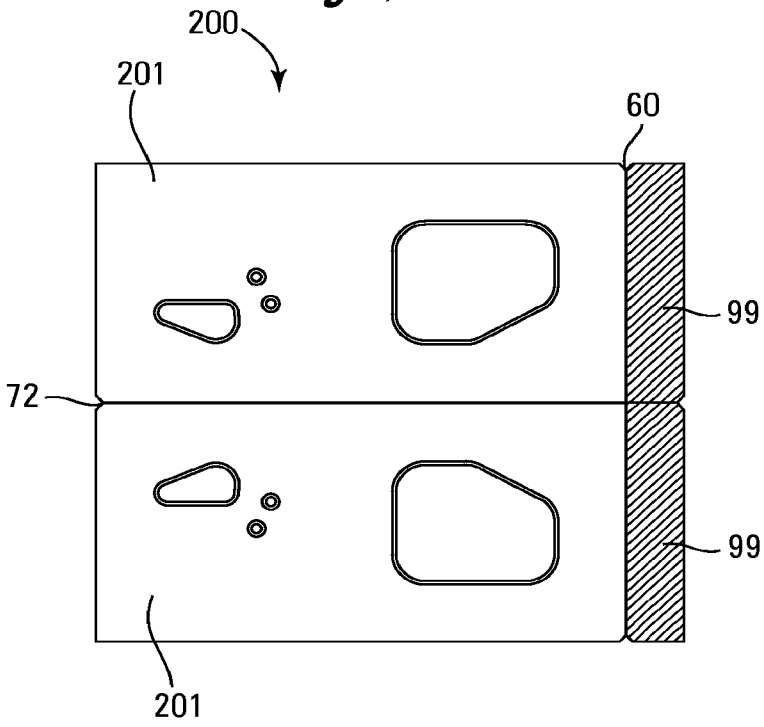
FIG. 4A is a top view of a corner block slab stripped from a mold box.
Figure 4B:
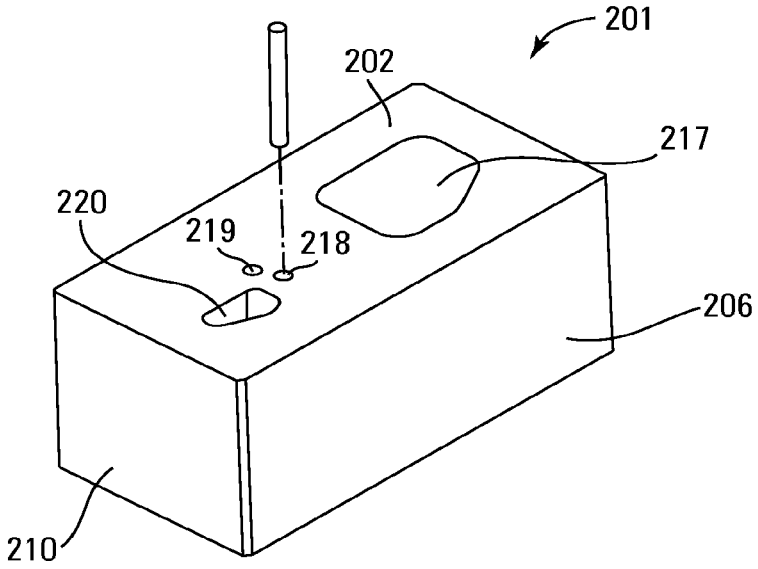
FIG. 4B is a perspective view of the corner block formed from the corner block slab of FIG. 4A.

Another embodiment of corner blocks formed in a mold box having features similar to mold boxes 10*a*, 10*b*, and 10*c* is shown in FIGS. 4A and 4B. FIG. 4A shows slab 200 formed in a mold box. Slab 200 is a double unit, meaning that slab 200 comprises two, joined corner blocks 201. The material shown in hatch marks is waste material 99 and is split away from the slab at outboard split lines 60 forming textured sides surfaces of the blocks. Center split line 72 shown in dashed defines the boundary where slab 200 can be split to form corner blocks 201 as shown in FIG. 4B. It should be noted that side and end face liners could be used to impress a texture onto one or multiple surfaces of the blocks as in the mold boxes of FIGS. 1A to 1C and depending upon the application no splitting at split line 60 would be necessary. Additionally division plates may be utilized to eliminate the need for splitting at split line 72 depending upon the application.

Corner block 201 has textured front face 206 and textured side face opposite face 210 formed from the splitting of the block after slab 200 was formed in a mold box. Block 201 illustrates an alternative arrangement in the placement of pin holes and pin receiving cavities. Top surface 202 has core 217 and first and second pin holes 218 and 219 which extend between top and bottom faces surfaces of the block. Pin receiving cavity 220 also extends between the top and bottom surfaces and is "triangular shaped", that is, the cavity is generally triangular but with radii at the intersection of all planes. The shape and size and location of the cavity is selected to maximize the strength of the block while at the same time, since they extend between the top and bottom surfaces, the block weight is minimized. The cavities may be tapered, for ease of manufacturing. That is, the area of the triangular shape in the top of the block preferably is slightly larger than the area of the triangular shape in the bottom of the block. The first and second pin holes are also slightly to the rear of the pin receiving cavities Pin holes typically extend through to the bottom surface of the block and are sized to receive a pin 80. In forming a wall from the blocks, a pin is installed in a pin hole and projects from the top face of an underlying block by, for example, approximately 20 mm to engage the pin receiving cavity of an overlying block. In this manner, the pin in a block on a lower course of blocks in a wall engages a pin receiving cavity of a block in an upper course. This results in an interlocking of the blocks with a predetermined setback.

Though block 201 may have various dimensions, typical dimensions of this block are about 9 inches (22.9 cm) wide (i.e., the width of the side surfaces), 18 inches (45.7 cm) long (i.e., the length of front face 206), and 8 inches (20.4 cm) thick (i.e., the thickness between the opposing upper and lower surface).

Corner block 201 can be used in the formation of corners in a wall system with various blocks as so desired. For example, corner block 201 can be used with the Compac Unit straight-face block manufactured by Keystone Retaining Wall Systems, Inc., Bloomington, Minn.

Figure 5A:
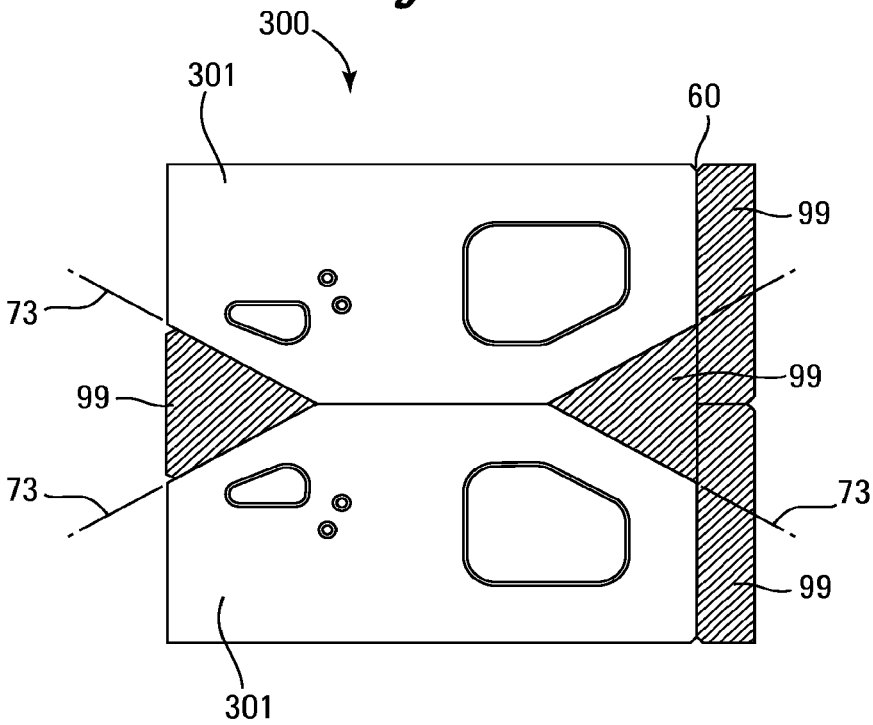
FIG. 5A is a top view of a second corner block slab stripped from a mold box.
Figure 5B:
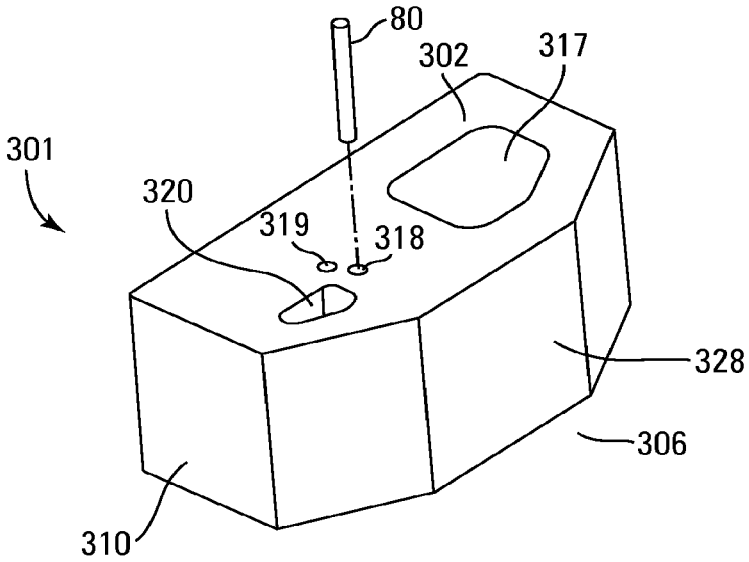
FIG. 5B is a perspective view of the corner block formed from the corner block slab of FIG. 5A.

FIGS. 5A and 5B show a further embodiment of corner blocks in accordance with the present invention. FIG. 5A shows slab 300 formed in a mold box. Slab 300 is a double unit, meaning that slab 300 comprises two, joined corner blocks 301. The material shown in hatch marks is waste material 99 and is split away from the slab at outboard split lines 60 forming textured sides surfaces of the blocks. Center split line 73 shown in dashed defines the boundary where slab 300 can be split with the splitter blade disclosed in U.S. Provisional Patent Application Serial No. 60/933,309 entitled "Block Splitter Assembly and Method of Producing Wall Blocks", filed Jun. 6, 2007, hereby incorporated herein by reference (a copy of this application is included and forms part of the subject of this application). This split results in the front faces of the corner block having angular textured surfaces with additional waste material 99 being split away from both of the corner blocks 301. It should be noted that side and end face liners could be used to impress a texture onto one or multiple surfaces of the blocks as in the mold boxes of FIGS. 1A to 1C and depending upon the application no splitting at split line 60 would be necessary.

Corner block 301 has textured angular multifaceted front face 306 and a textured side opposite face 310 formed from the splitting of the block after slab 300 was formed in a mold box. Central surface 328 of front face 306 is substantially planar to the rear face of the corner block. The arrangement of pin holes and pin receiving cavities is similar to that described with respect to block 201. Top surface 302 has core 317 and first and second pin holes 318 and 319 which extend between top and bottom faces surfaces of the block. Pin receiving cavity 320 also extends between the top and bottom surfaces and is triangular shaped, that is, the cavity is triangular with corner radii, having no sharp angles. The shape and size and location of the cavity is selected to maximize the strength of the block while at the same time, since they extend between the top and bottom surfaces, the block weight is minimized. The cavities may be tapered, for ease of manufacturing. That is, the area of the triangular shape in the top of the block preferably is slightly larger than the area of the triangular shape in the bottom of the block. The first and second pin holes are also slightly to the rear of the pin receiving cavities Though block 301 may have various dimensions, typical dimensions of this block are about 9 inches (22.9 cm) wide (i.e., the width of the side surfaces from the back face to the front central surface 328), 18 inches (45.7 cm) long (i.e., the length of front face 206), and 8 inches (20.4 cm) thick (i.e., the thickness between the opposing upper and lower surface).

Corner block 301 can be used in the formation of corners in a wall system with various blocks as so desired. For example, corner block 301 can be used with the Compac Unit or the Compac II Unit blocks manufactured by Keystone Retaining Wall Systems, Inc., Bloomington Minn.

Figure 6A:
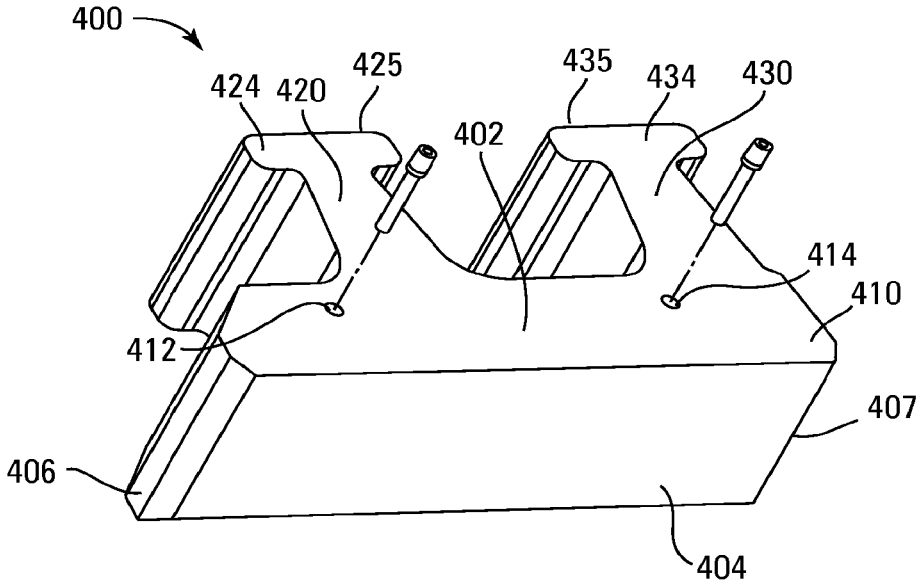
Fig. 6A Prior Art
FIGS. 6A and 6B are perspective views of a block used with the corner block of FIG. 1B.
Figure 6B:
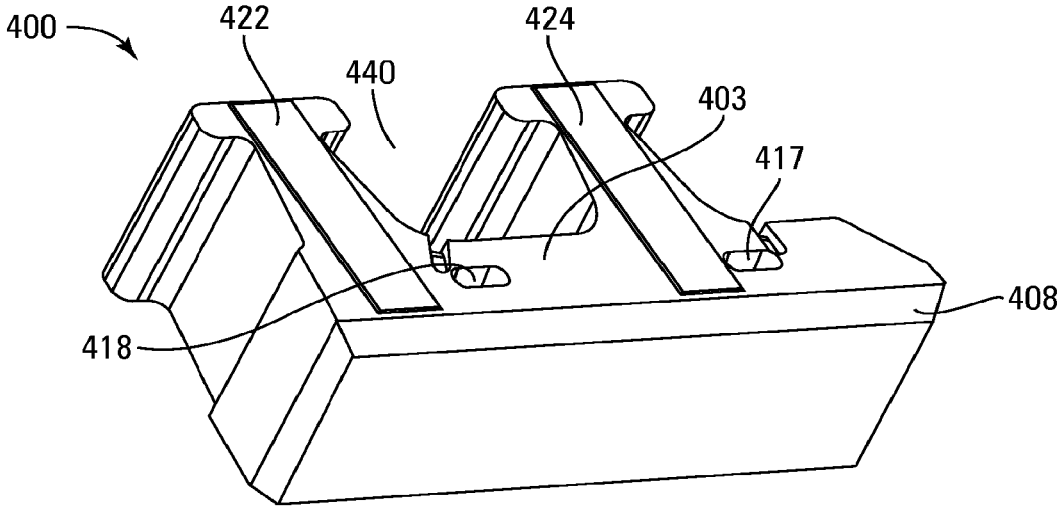
Fig. 6B Prior Art

FIGS. 6A and 6B illustrate block 400 as disclosed in U.S. Provisional Patent Application Ser. No. 60/986,483, entitled "Wall Block with Weight Bearing Pads and Method of Producing Wall Blocks", filed Nov. 8, 2007, hereby incorporated herein by reference (a copy of this application is included and forms part of the subject of this application). Block 400 has parallel top face 402 and bottom face 403. Front face 404 shows a line 408 adjacent the top and sides of the block which represents the thickness of the impressed texture from the molding process and is generally ¾ to 1 inch thick. The length of face 404 is defined by the distance between corners 406 and 407. Extending from front portion 410 are two legs 420 and 430. Legs 420 and 430 extend to rear portions 424 and 434, respectively, having rear faces 425 and 435, respectively. Front face 404 and rear faces 425 and 435 each extend from top face 402 to bottom face 403. The distance between faces 402 and 403 defines the thickness of the block. Although the size of block 400 may be varied as desired, a typical size for the front face is 24 inches long (61 cm) by 8 inches (20.3 cm) thick.

Legs 420 and 430 are separated by void 440. Each leg 420 and 430 has two side walls, respectively. These side walls generally converge from the front to the back of the block. The side walls extend from top face 402 to bottom face 403. In a preferred embodiment, legs 420 and 430 are positioned such that, when stacking blocks one on top of another in a wall, a leg of one block is placed over a leg in an underlying block and a running bond pattern is created. The alignment of legs is desirable because it adds to the structural stability of a wall, and also permits the introduction of an area for vertical reinforcement or drainage fill materials that would extend through voids between adjacent legs. By stacking the legs one upon the other it appears as pilasters on the back of the wall structure. The legs align and stack one upon the other to form integrated pilasters to the wall.

Front portion 410 includes front face 404 and also includes pin holes 412 and 414 and pin receiving cavities 417 and 418.

Pin receiving cavities 417 and 418 are positioned at any desired location along the front portion of the block and may have any desired shape. The placement of cavities in conjunction with pin holes 412 and 414 can be used to form a running-bond pattern in a wall of blocks. The pin receiving cavities may extend from the top to the bottom of the block, which aids in minimizing block weight, or may only partially extend toward the bottom of the block. However, they also could be depressions in the block rather than passageways.

Pin holes 412 and 414 extend from the top face 402 to bottom face 403. Two pin holes are shown, but more or fewer pin holes may be used. The holes are generally straight but may be tapered to ease the removal of forming elements from the molded block. These pin holes are sized to receive a connecting element, such as a pin. The pin may be a shouldered pin, in which case the pin hole may be substantially the same diameter for the thickness of the block, or the pin holes may be truncated to allow a portion of a headless pin to sit above the surface of the block.

Lower surface 404 of the block also has raised surfaces 422 and 424 which function as weight bearing pads. These weight bearing pads may be imparted onto the bottom surface of block 400 by adjustable or stationary tamper heads which are recessed into the lower portion of a stripper shoe of the molding process as described above. The pads are positioned on the blocks so that the load or stress areas of a wall are formed directly above a weight bearing pad on the underlying block. In other words, when a wall is formed from the blocks 400 in a running bond pattern as shown in FIG. 7C the pads in each course align vertically. Since there are no areas of high stress that do not have underlying support, the problem of block cracking is eliminated even if the block thickness is not consistent within an acceptable range as may be caused by worn, misaligned or irregular equipment or machinery used in the block molding process.

Figure 7:
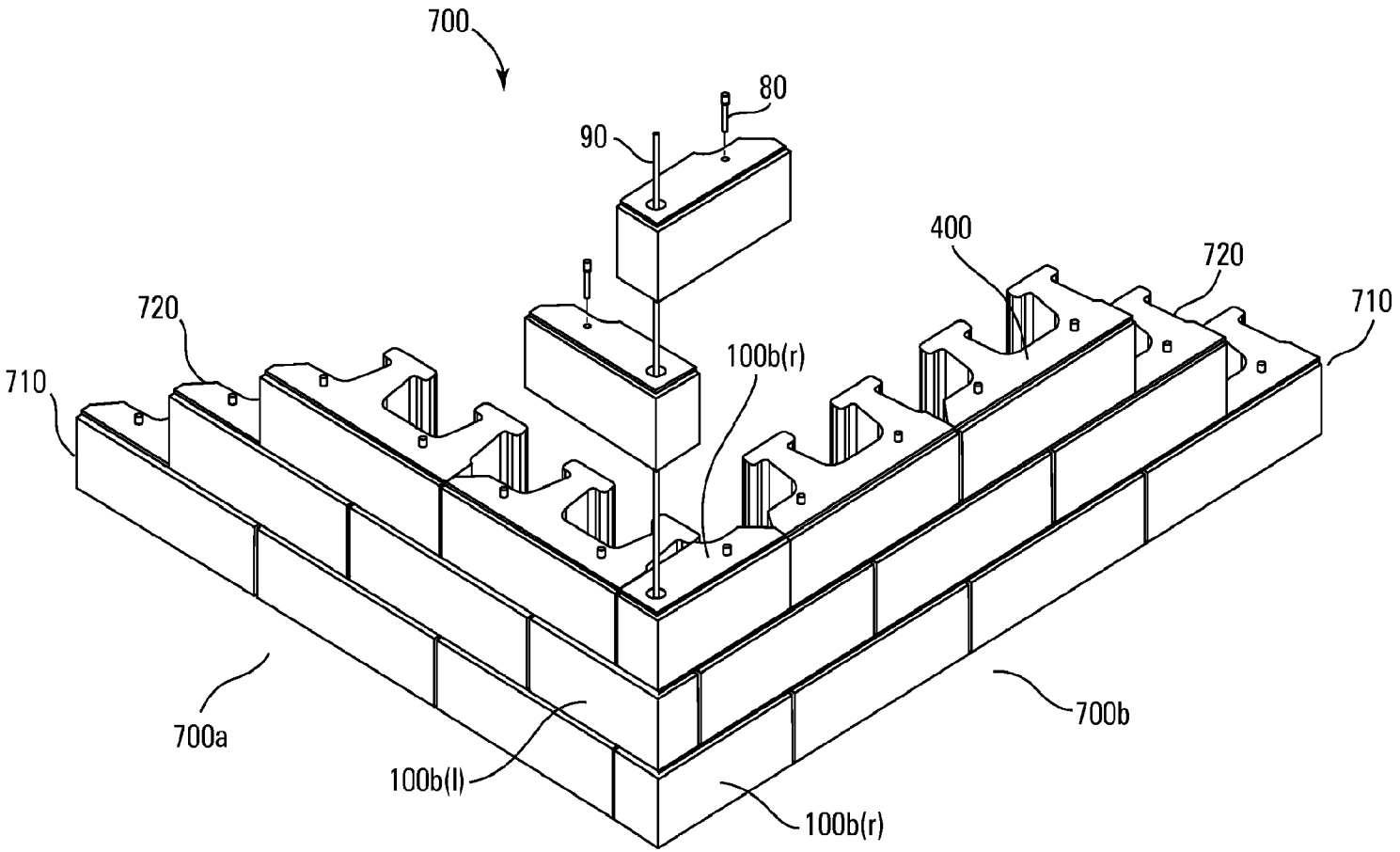
FIG. 7 is a perspective view of a wall made with the blocks of FIGS. 6A and 6B and with the corner block of FIG. 1B of the present invention.

FIG. 7 illustrates a wall 700 built with right hand and left hand corner blocks 100*b* and wall blocks 400. Generally, when constructing a wall, a trench is excavated to a preselected depth and lined with a level base of granular material such as crushed stone. A base layer is then placed and leveled onto the crushed stone. The blocks of the straight section of the wall are placed end to end with a front face projecting outwardly. The corner of the base layer is formed by the placement of a right handed or left handed corner block of the present invention at the desired location for the corner. Base layer 710 is shown with a right handed corner block 100*b*(*r*) which offsets the base layer of straight wall portion 700*b* by the length of front face 106 of corner block 100*b*(*r*), the base layer of straight wall portion 700*a* is thus offset by the length of side surface 110 of corner block 100*b*(*r*). Pins 80 may be placed into pin holes 118 of corner block 100*b*(*r*) and additionally into pin holes 412 and 414 of blocks 400 of the base layer.

The dimensions of corner blocks 100*b* make them particularly well suited to be used with wall blocks 400 in forming a 90° wall corner. In particular, the length of front surface 106 is 18 inches (45.7 cm). The width of side surface 110 is 6 inches (15.2 cm). Thus, when the orientation of corner blocks 100*b* is alternated in adjacent courses as shown in FIG. 7, the wall blocks 400 closest to the corner in each wall portion are spaced from the corner by either 6 inches (15.2 cm) or 18 inches (45.7 cm). The result is that wall blocks 400 align in a running bond pattern from course to course. This results from the fact that the difference between the length of front surface 106 and side surface 110 is 12 inches or one-half the 24 inch length of the front surfaces of wall blocks 400.

Once the base layer is laid, first layer 720 of blocks is placed on the base layer and pin receiving cavity 120 of corner block 100*b*(1) and pin receiving cavities 417 and 418 of blocks 400 of the first course capture the heads of pins 80 in base layer 710. This pin alignment system is thus compatible with both the corner block and the wall block thus adding to the overall stability and structural integrity of the structure being built. First layer 720 is shown with left handed corner block 100*b*(1) which offsets the base layer of straight wall portion 700*a* by the length of front face 106 of corner block 100*b*(1), the first layer of straight wall portion 700*a* is thus offset by the length of side face 110 of corner block 100*b*(1). In this embodiment the placement of blocks is vertically offset in adjacent courses in a running bond pattern by the use of the alternating courses of the left and right handed corner blocks 100*b*. It is to be understood that a wall could be formed using only left handed corner blocks or right handed corner blocks but the wall would have a stacked bond configuration. Pins 80 may be placed into the pin holes of the blocks of the first layer.

Subsequent layers of blocks can then be placed one on top of the next with the pin connection system while alternating the left and right handed corner blocks of adjacent layers of the wall until the desired height is reached. The specific dimensions of the corner block ensure that seams between blocks of one course will not be directly vertically adjacent to the same seam between blocks in the adjacent course. The alignment of cores 117 of the alternating courses of left and right handed corner blocks 100*b* create a vertical columnar cavity at the corner of wall 700. Steel, fiberglass or other suitable rebar 90 can be thread through the columnar cavity and may additionally be filled with concrete grout for additional stability. It should be additionally noted that the columnar cavities may be filled with a stabilizing material such as sheer resistant fill (i.e. crushed stone), concrete or the like with or without the need for rebar depending upon the application. The crushed stone of generally ¾ inch size creates a sheer resistance from one block slipping horizontally from another block above or below. This is typical for structural wall applications. Optionally, construction adhesive may be used to lock blocks and/or courses together with or without the use of stabilizing materials on landscape walls. A geogrid as known and used in the art is may be used in the construction of wall 700 depending upon the application but isn't a requirement with gravity walls versus structural walls. Once the desired height is reached a capping layer may be added.

Figure 8A:
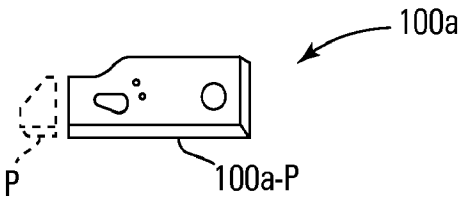
FIG. 8A is a top view of the corner block of FIG. 1A with a portion removed.

The corner blocks of the present invention can be modified for use with wall blocks of different sizes. As described above, the corner blocks are particularly well suited for use with wall blocks which have a front surface length equal to twice the difference between the length of front surface 106 and side surface 110. For example, FIG. 8A illustrates block 100*a* made from mold box 10*a* of FIG. 1A which has had a portion P removed or cut from corner block 100*a* in order to adjust the front surface length. The remaining portion comprises a block 100*a*-P. The removed portion of the block at the neck 116 is easier to remove than from the body of the corner block because of the narrowed contour of the neck portion. Corner block 100*a* as formed in the mold has a single orientation since the top and bottom surfaces are the same, thus the block may be flipped over to have either the top surface or bottom surface of the block facing down. However it is to be noted that if the top and bottom surfaces were to be molded with differences, a right and left handed orientation would result and would also be compatible with the blocks listed below and with the wall system of the present invention.

Figure 8B:
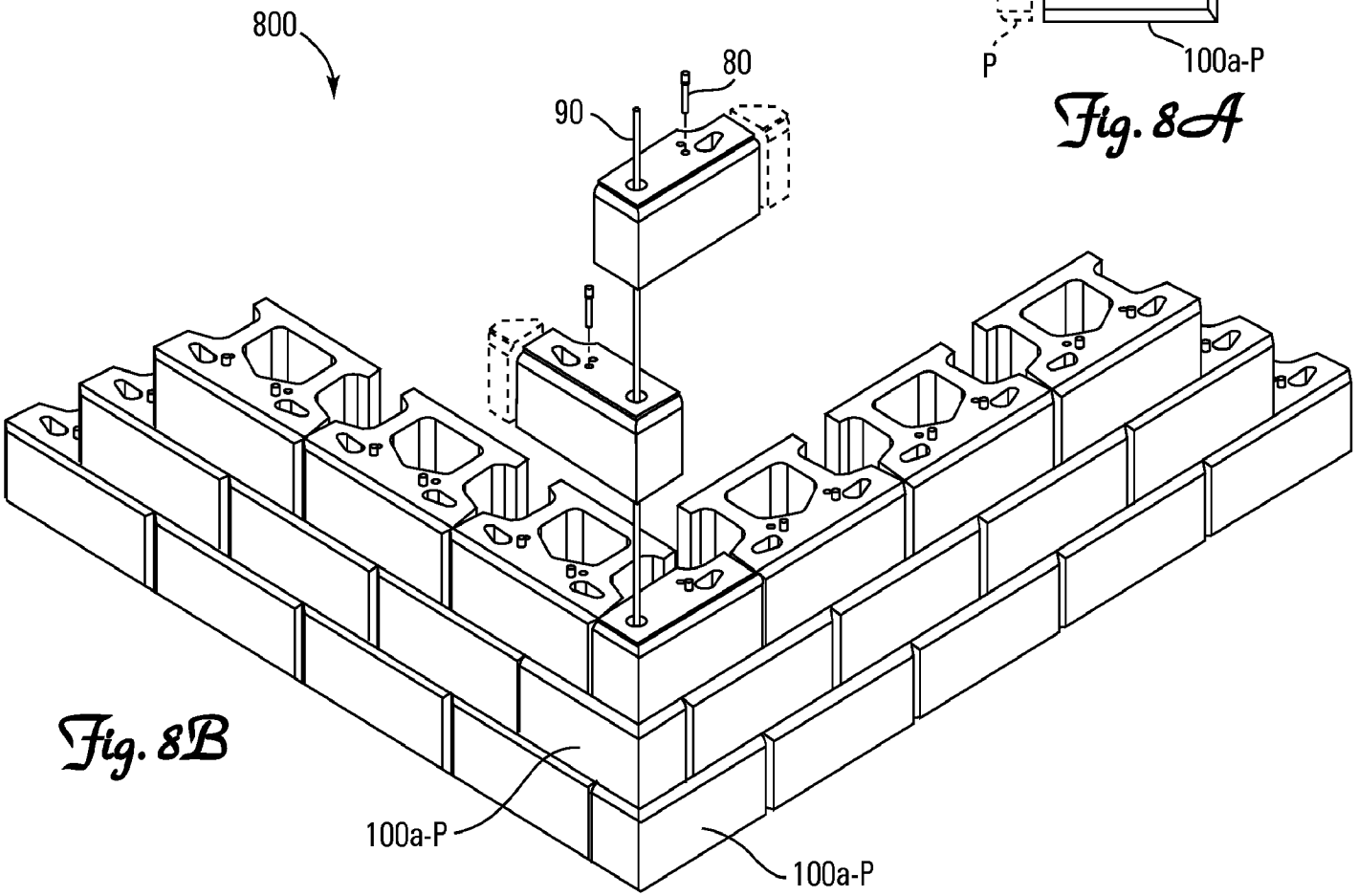
FIG. 8B illustrates the corner block of FIG. 8A used in the formation of a wall.

FIG. 8B illustrates wall 800 constructed with a cut-off corner block 100*a*-P of FIG. 8A and a wall block such as the Compac Unit straightface blocks manufactured by Keystone Retaining Wall Systems Inc., Bloomington, Minn. The typical size of the front face is 18 inches long by 8 inches thick. In order for the corner block to work with a wall block of this size a portion of the corner block is removed to adjust its dimensions in order to be compatible with the dimensions and the pin alignment system of the Compac Unit straightface block. Since the corner block is made with a front surface length of 18 inches, and since the width of its side surface is 6 inches, the portion removed is about 3 inches. This results in an adjustment in the front surface length of the corner block to 15 inches. The difference between the adjusted length and the width of the side surface is 9 inches or one-half the length of the front face of the wall blocks used to construct the wall. The block can be field cut to the desired length. Additionally a scribe or indentation marking may be molded to the surface of the corner block to help determine the cut-off point. The corner block may also be molded to the reduced dimension if it is needed for a particular application. The structure is built substantially similarly as described above but without the left and right handedness of the block unless block 100*a* has been molded with differing top and bottom surfaces. In order to make block 100*a* compatible with these wall blocks a pin hole and pin receiving cavity arrangement substantially similar to that of block 201 of FIG. 4B is provided. This ensures that as the wall is built the pin holes and pin receiving cavities of blocks 100*a* will align with those of the wall blocks in upper and lower courses to maintain the strength and stability of the wall without the need to use adhesives or other bonding agents. As the structure is being built and more courses are added, more of the neck portion of the block may be cut off to correct any imperfections of the blocks that are magnified as the structure is built higher and higher or to make appropriate adjustments if the wall is built with a setback.

Although particular embodiments have been disclosed herein in detail, this has been done for purposes of illustration only, and is not intended to be limiting with respect to the scope of the claims. In particular, it is contemplated that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A method for constructing a wall which includes left and right visible wall portions which meet at a corner, the method comprising:

providing a plurality of wall blocks having opposed top and bottom surfaces, opposed side surfaces, and opposed front and back faces, each opposed side surface having a length being the distance from the front face to the back face; providing a plurality of corner blocks having a block body, the block body including opposed top and bottom surfaces, opposed front and back faces, the back face having a length, the front face having a length including a first portion having a length equal to the length of the back face and a second portion, the first portion of the length of the front face being greater than the second portion of the length of the front face, first and second side surfaces, the first side surface having a length and being orthogonal to the first portion of the front face and to the back face and the second side surface being orthogonal to the front face and having a length less than the length of the first side surface, and a neck, the neck including the second portion of the front face, the second side surface and a back surface extending from the back face to the second side surface; placing the wall blocks and corner block in a first course wherein the wall blocks are assembled such that the front faces form the left and right visible wall portions except at the corner and the corner block is assembled such that the front face is exposed along the first visible wall portion and the first side surface is exposed along the second visible wall portion and wherein the second side surface of the corner bock is positioned adjacent to a side surface of the wall block, the length of the second side surface of the corner block being less than the length of the side surface of the wall block; stacking the wall blocks and corner block in a second course on top of the first course wherein the wall blocks are assembled such that the front faces form the left and right visible wall portions except at the corner and the corner block is assembled such that the first side surface is exposed along the first visible wall portion and the front face is exposed along the second visible wall portion and wherein the second side surface of the corner bock is positioned adjacent to a side surface of the wall block, the length of the second side surface of the corner block being less than the length of the side surface of the wall block; and stacking alternating first and second courses until the desired height of the wall is reached.

2. The method of claim 1 wherein the step of providing a plurality of corner blocks includes that the length of the front face of the corner blocks less the width of the first side surface of the corner blocks is equal to about one-half the length of the front face of the wall blocks.

3. The method of claim 1 wherein the step of placing the wall blocks and corner block in a first course further includes that the bottom surface of the corner block is positioned facing down and wherein the step of stacking the wall blocks and corner block in a second course on top of the first course further includes that the top surface of the corner block is positioned facing down.

4. The method of claim 1 wherein the step of providing a plurality of corner blocks includes providing a plurality of first and second corner blocks, the first corner blocks having the first side surface on a left side of the block and the second corner block having the first side surface on a right side of the block and wherein the step of laying the wall blocks and corner block in a first course further includes placing the first corner block in the first course and wherein the step of stacking the wall blocks and corner block in a second course on top of the first course further includes stacking the second corner block in a second course.

5. The method of claim 1 wherein the step of providing a plurality of corner blocks includes that the front face of the wall blocks have a pattern impressed into the front face and wherein the first side surface and front face of the corner blocks have a substantially similar pattern impressed into the first side surface and front face.

6. The method of claim 1 further comprising:

removing at least of portion of the neck of the block body of the plurality of corner blocks such that at least a length of the second portion of the front face of the corner block is removed.

7. The method of claim 1 wherein the step of providing a plurality of wall blocks includes that the wall blocks have pin holes and pin receiving cavities and wherein the step of providing a plurality of corner blocks includes that the corner blocks have pin holes and pin receiving cavities and wherein the step of placing the wall blocks and corner blocks in a first course includes placing pins in the pin holes of the wall blocks and corner block and wherein the step of stacking the wall blocks and corner block in a second course on top of the first course includes receiving a head of the pin from the first course in the pin receiving cavities of the wall blocks and corner block of the second course.

8. A wall block system for forming in multiple courses a wall which includes first and second visible wall portions which meet at a corner, the wall system comprising:

a plurality of first and second blocks having opposed top and bottom surfaces, opposed side surfaces, and opposed front and back faces, each opposed side surface having a length being the distance from the front face to the back face, the first and second blocks being configured to be assembled in adjacent courses such that the front faces of the first blocks form the first visible wall portions, and the front faces of the second blocks form the second visible wall portions, except at the corner;

a plurality of corner blocks having a block body, the block body including opposed top and bottom surfaces, opposed front and back faces, the back face having a length, the front face having a length including a first portion having a length equal to the length of the back face and a second portion, the first portion of the length of the front face being greater than the second portion of the length of the front face, first and second side surfaces, the first side surface having a length and being orthogonal to the first portion of the front face and to the back face and the second side surface being orthogonal to the front face and having a length less than the length of the first side surface, and a neck portion, the neck portion including the second portion of the front face, the second side surface and a back surface extending from the back face to the second side surface; wherein the corner blocks are configured to be assembled in courses at the corner of the wall in an alternating manner such that the front face and first side surface of a corner block in a first course are exposed along the first visible wall portion and second visible wall portion, respectively, and the front face and first side surface of corner blocks in adjacent courses are exposed along the second visible wall portion and the first visible wall portion, respectively, and wherein the second side surface of each corner bock assembled in courses at the corner of the wall are positioned adjacent to a side surface of the first and second block, the length of the second side surface of the corner block being less than the length of the side surface of the first and second block.

9. The wall block system of claim 8 wherein the length of the front face of the corner blocks less the width of the first side surface of the corner blocks is equal to about one-half the length of the front face of the first blocks.

10. The wall block system of claim 8 wherein the front face of the first blocks have a pattern impressed into the front face and wherein the first side surface and front face of the corner blocks have a substantially similar pattern impressed into the first side surface and front face.

11. The wall block system of claim 8 wherein the bottom surface of the corner block is positioned facing down in the first course and wherein the top surface of the corner block is positioned facing down in the second course.

12. The wall block system of claim 8 wherein the first blocks and the corner blocks include at least one weight bearing surface extending above or below the top or bottom surface, respectively.

13. The wall block system of claim 8 wherein the first blocks and corner blocks include a pin hole and a pin receiving cavity.

14. The wall block system of claim 13 wherein the pin hole and pin receiving cavity of the corner blocks are located in the neck portion.

15. A wall block system for forming in multiple courses a wall which includes left and right visible wall portions which meet at a corner, the wall system comprising:

a plurality of wall blocks having opposed top and bottom surfaces, opposed side surfaces, and opposed front and back faces, each opposed side surface having a length being the distance from the front face to the back face, the wall blocks being configured to be assembled in adjacent courses such that the front faces of the wall blocks form the left and right visible wall portions except at the corner; a plurality of first corner blocks having a block body, the block body including opposed top and bottom surfaces, opposed front and back faces, the back face having a length, the front face having a length including a first portion having a length equal to the length of the back face and a second portion, the first portion of the length of the front face being greater than the second portion of the length of the front face, left and right side surfaces, the left side surface having a length and being orthogonal to the first portion of the front face and to the back face and the right side surface being orthogonal to the front face and having a length less than the length of the left side surface, and a neck portion, the neck portion including the second portion of the front face, the right side surface and a back surface extending from the back face to the right side surface; a plurality of second corner blocks having a block body, the block body including opposed top and bottom surfaces, opposed front and back faces, the back face having a length, the front face having a length including a first portion having a length equal to the length of the back face and a second portion, the first portion of the length of the front face being greater than the second portion of the length of the front face, left and right side surfaces, the right side surface having a length and being orthogonal to the first portion of the front face and to the back face and the left side surface being orthogonal to the front face and having a length less than the length of the right side surface, and a neck portion, the neck portion including the second portion of the front face, the left side surface and a compound back surface extending from the back face to the left side surface; wherein the first and second corner blocks are configured to be assembled in courses at the corner of the wall in an alternating manner such that the front face of the first corner block is exposed on the right visible portion of the wall and the left side surface of the first corner blocks is exposed on the left visible portion of the wall and wherein the front face of the second corner block is exposed on the left visible portion of the wall and the right side surface of the second corner block is exposed on the right visible portion of the wall and wherein the second side surface of each corner bock assembled in courses at the corner of the wall are positioned adjacent to a side surface of the wall block, the length of the second side surface of the corner block being less than the length of the side surface of the wall block.

16. The wall block system of claim 15 wherein the length of the front face of the first corner blocks less the width of the left side surface of the first corner blocks is equal to about one-half the length of the front face of the wall blocks and the length of the front face of the second corner blocks less the width of the right side surface of the second corner blocks is equal to about one-half the length of the front face of the wall blocks.

17. The wall block system of claim 15 wherein the front face of the wall blocks have a pattern impressed into the front face and wherein the left side surface and front face of the first corner blocks have a substantially similar pattern impressed into the left side surface and front face and wherein the right side surface and front face of the second corner blocks have a substantially similar pattern impressed into the right side surface and front face.

18. The wall block system of claim 15 wherein the wall blocks and the first and second corner blocks include at least one weight bearing surface extending above or below the top or bottom surface, respectively.

19. The wall block system of claim 15 wherein the top surface of the first and second corner blocks include a pin hole and the bottom surface of the first and second corner blocks include a pin receiving cavity.

20. The wall block system of claim 19 wherein the pin hole and pin receiving cavity of the first and second corner blocks are located in the neck portion.

* * * * *